United States Patent [19]

Skaggs

[11] 4,211,355

[45] Jul. 8, 1980

[54] PARTITION

[75] Inventor: Boyd T. Skaggs, Louisville, Ky.

[73] Assignee: Container Corporation of America, Chicago, Ill.

[21] Appl. No.: 61,697

[22] Filed: Jul. 30, 1979

[51] Int. Cl.[2] ..... B65D 5/48

[52] U.S. Cl. ..... 229/15; 229/28 R; 217/23

[58] Field of Search ..... 229/15, 28 R, 42, 29 R; 217/23

[56] References Cited

U.S. PATENT DOCUMENTS

| | | | |
|---|---|---|---|
| 1,459,017 | 6/1923 | Dean | 229/19 |
| 2,723,796 | 11/1955 | Malmgren | 229/29 R X |
| 3,300,076 | 1/1967 | Wohl | 217/23 |
| 3,363,823 | 1/1968 | Paige et al. | 229/15 R |
| 3,738,561 | 6/1973 | Nedenveld | 229/15 R |
| 3,743,163 | 7/1973 | Helms | 229/15 R |
| 3,756,496 | 9/1973 | Oostdik | 229/15 R |
| 3,931,924 | 1/1976 | Gardner et al. | 229/28 R |
| 4,124,158 | 11/1978 | Beck | 229/28 R X |
| 4,144,995 | 3/1979 | Travis | 229/15 R |

*Primary Examiner*—Davis T. Moorhead

*Attorney, Agent, or Firm*—Carpenter & Ostis

[57] ABSTRACT

A readily erectable multi-cell partition formed from a unitary blank of foldable paperboard.

2 Claims, 5 Drawing Figures

PARTITION

SUMMARY OF THE INVENTION

This invention relates to internal partition structures and more particularly to a paperboard partition adapted for use within an outer container or wrapper and which may be readily erected by hand or machine.

It is a primary object of the invention to provide a onepiece paperboard partition structure of relatively simple design and construction which may be easily and quickly assembled automatically or by hand.

A more specific object of the invention is to provide a partition structure wherein certain of the panels or walls are foldably joined to other panels or walls by gusset means which permit the structure to be quickly folded to the erected condition by merely pressing on four points at the same time.

These and other objects of the invention will be apparent from an examination of the following description and drawings.

THE DRAWINGS

Figure 2:
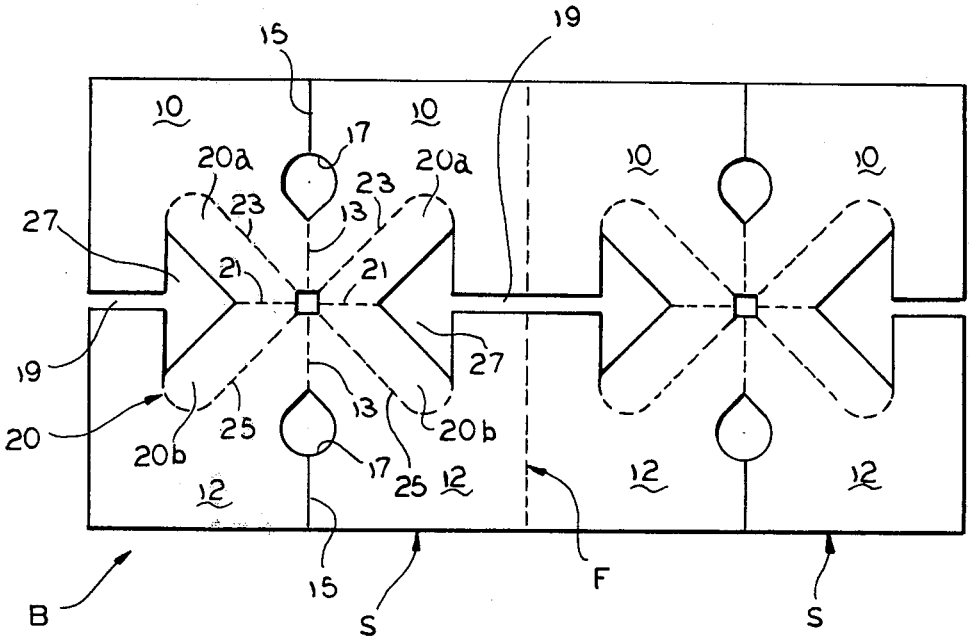
FIG. 2 is a plan view of the blank from which the structure of the other views may be formed.

It will be understood that, for purposes of clarity, certain elements may have been intentionally omitted from certain views where they are believed to be illustrated to better advantage in other views.

THE DESCRIPTION

Referring now to the drawings for a better understanding of the invention, it will be seen that a partition structure, indicated generally at P, may be formed from a unitary blank B of the foldable sheet material such as paperboard. If desired the partition may have a plurality of similar sections S joined to each other along one or more fold lines F.

For the purpose of describing the invention, reference will be made to a single section which, when erected, provides for cells.

It will be seen that each section of the partition includes a pair of first panels or wall 10 and a pair of second panels or walls 12 with the panels of each pair being joined to each other by fold lines 13, which are aligned with each other and which extend generally normal to an edge of blank B.

For ease of folding, if desired, fold lines may not extend along the entire lengths of the walls, with portions of the panels being separated from each other by cut lines 15, which are aligned with the fold lines 13 but spaced therefrom by finger holes 17 which assist in grasping and erecting the partition.

Each pair of walls is separated from the other by cut-out portions or spaces 19, located at opposite sides of the walls.

Each wall of each pair is foldably joined to a corresponding wall of the other pair by a gusset member 20 which includes a pair of preferably elongated gusset elements **20*a* and 20*b* which are joined to each other at corresponding inner ends along fold line 21 which extends in a direction normal to fold lines 13**.

Gusset elements **20*a* and 20*b* of each gusset member are foldably joined to adjacent edges of a wall 10 and a wall 12 along fold lines 23 and 25**, respectively.

To aid in folding and to provide apertures for receiving portions of packaged articles, portions of the walls may be cut out as indicated at 27.

Figure 1:
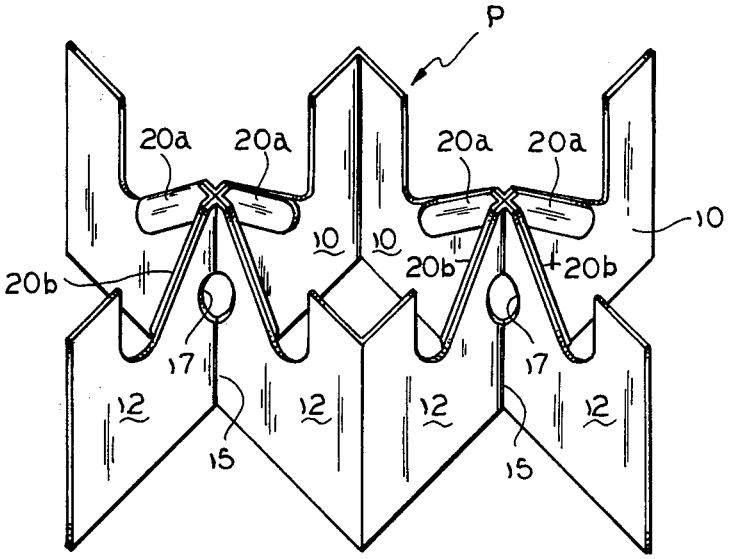
FIG. 1 is a perspective view of a partition embodying features of the invention.
Figure 3:
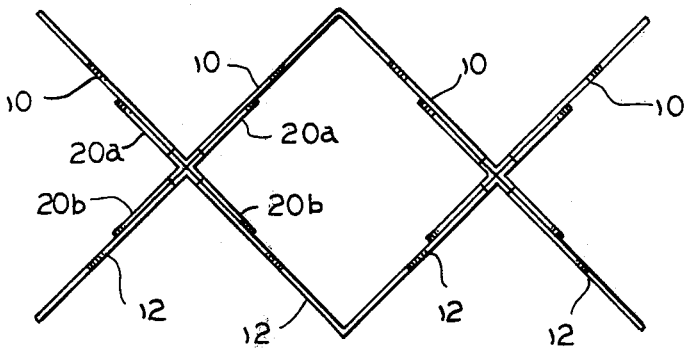
FIG. 3 is a plan view of the structure of FIG. 1.
Figure 4:
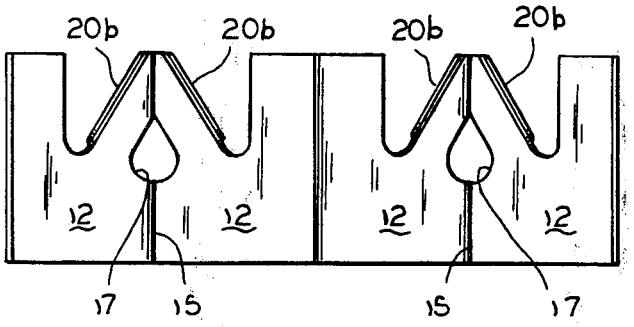
FIG. 4 is a front elevation of the structure of FIG. 1.
Figure 5:
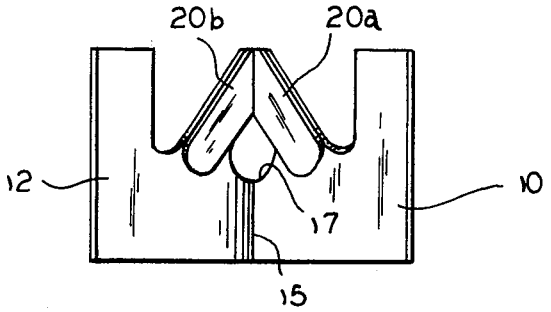
FIG. 5 is an end elevation of the structure of FIG. 1.

In order to erect each section of the partition, it is grasped by finger holes 17 and lifted. Pressure is then applied by the fingers pressing on the four fold lines 13, 13, 21, 21 adjacent the center of the partition to cause the partition to self erect to the structure illustrated in FIG. 1.

When in the erected condition, panels or walls 10—10 are aligned with each other at right angles to panels 12—12, with the gusset elements of each gusset member folded against the upper marginal portion of its respective portion wall or panel.

I claim:

1. A readily erectable, multi-cell partition formed from a generally rectangular unitary blank of foldable sheet material, such as paperboard, comprising:

(a) a first pair of generally rectangular walls disposed in intersecting planes normal to each other and foldably joined to each other along a first fold line disposed normal to a side edge of said blank;

(b) a second pair of generally rectangular walls disposed in intersecting planes normal to each other and aligned with said first mentioned planes and foldably joined to each other along a second fold line disposed parallel to and adjacent said first fold line;

(c) first and second gusset means foldably joining a first wall of said first pair to an adjacent first wall of said second pair and a second wall of said first pair to an adjacent second wall of said second pair;

(d) each of said gusset means including a pair of gusset elements foldably joined to each other along another fold line disposed parallel to and adjacent said first and second fold lines and being foldably joined to respective adjacent walls of said pairs along fold lines which converge inwardly toward the intersection of planes of said walls.

2. A generally rectangular unitary blank of foldable sheet material, such as paperboard, for forming a readily erectable, multi-cell partition, said blank being cut and scored to provide:

(a) a first pair of generally rectangular wails having corresponding side edges foldably joined to each other along a first fold line disposed normal to a side edge of said blank;

(b) a second pair of generally rectangular walls having corresponding side edges foldably joined to each other along a second fold line disposed in alignment with said first fold line;

(c) first and second gusset means foldably joining a first wall of said first pair to an adjacent first wall of said second pair and a second wall of said first pair to a second wall of said second pair;

(d) each of said gusset means including a pair of gusset elements foldably joined to each other along another fold line disposed in a plane intersecting and normal to the plane of said first and second fold lines and being foldably joined to respective adjacent walls of said pairs along fold lines which converge inwardly toward the intersection of the planes of said first, second, and other fold lines.

* * * * *